United States Patent [19]

Brewster et al.

[11] Patent Number: 4,683,069

[45] Date of Patent: Jul. 28, 1987

[54] GLYCEROL ESTERS AS FUEL ECONOMY ADDITIVES

[75] Inventors: Phillip W. Brewster; Clinton R. Smith; Frederick W. Gowland, all of Camlachie, Canada

[73] Assignee: Exxon Research & Engineering Co., Florham Park, N.J.

[21] Appl. No.: 572,935

[22] Filed: Jan. 23, 1984

Related U.S. Application Data

[63] Continuation of Ser. No. 260,987, May 6, 1981, abandoned.

[51] Int. Cl.[4] ..... C10M 137/10

[52] U.S. Cl. ..... 252/32.7 E; 252/33.4; 252/51.5 A; 252/56 R

[58] Field of Search ..... 252/22.7 E, 51.5 A, 252/33.4, 56 R

[56] References Cited

U.S. PATENT DOCUMENTS 2,911,367 11/1959 Bans et al. ..... 252/32.7 E 3,933,659 1/1976 Lyle et al. ..... 252/32.7 E

*Primary Examiner*—Jacqueline V. Howard

*Attorney, Agent, or Firm*—J. J. Mahon; S. H. Markowitz; J. B. Murray, Jr.

[57] ABSTRACT

Lubricating oil compositions are disclosed exhibiting improved fuel economy which contain 0.05 to 0.2 wt. % of a glycerol partial ester of a $C_{16}$-$C_{18}$ fatty acid as the fuel economy additive.

4 Claims, No Drawings

GLYCEROL ESTERS AS FUEL ECONOMY ADDITIVES

This is a continuation of application Ser. No. 260,987, filed May 6, 1981, now abandoned.

This invention relates to lubricating oil compositions which exhibit marked improvements in fuel economy. More particularly, this invention relates to lubricating oil compositions which contain very minor proportions of a glycerol fatty acid ester fuel economy additive. It is a current objective of the industry to provide lubricating oil compositions which exhibit improvements in fuel savings in gasoline and diesel engine vehicles. To meet that current goal, a new category of additives commonly referred to as fuel economy additives are being developed which function primarily to increase the miles or kilometers obtained per unit volume of fuel. Since modern day lubricating oil compositions are complex formulations, such additives must be compatible with the other components of such compositions and should not adversely affect the numerous other functions of conventional lubricant additives such as dispersancy, viscosity stability, corrosion and oxidation inhibition, and the like.

Illustrative of recent patents reflecting developments in this field are the U.S. Pat. No. 4,201,684 issued May 6, 1980 to Malec and U.S. Pat. No. 4,208,293 issued June 17, 1980 to Zaweski. These patents show the use of fatty acid amides and sulfurized amides as additives which have fuel economy benefits as demonstrated by friction reducing data. The present invention concerns the use of glycerol fatty acid esters as such fuel economy additives, specifically glycerol esters of $C_{16}$–$C_{18}$ fatty acids. There is prior art disclosing the use of such materials in lubricating oil compositions which is discussed hereinbelow.

West German Applications P-2949910 and P-2949940 of Chevron Research Company both published July 3, 1980 disclose the use of glycerol fatty esters as fuel economy additives. These publications correspond to U.S. patent application Ser. Nos. 970,698 and 970,699 both filed Dec. 18, 1978 by Liston. These references state that the addition of 0.25 to 2 weight percent, preferably 0.40 to 1.25 weight percent, of a fatty acid ester will offer a fuel economy credit of 2–3 percent in both gasoline and diesel engines. Glycerol oleic acid esters are preferred. West German Application P-2949940 illustrates the preferred embodiment showing the use of the glycerol ester at the same treat level in combination with zinc dihydrocarbyl dithiophosphate additives. In contrast to the teachings of these references, the present invention, resulting from engine testing of fully formulated compositions, is based upon the discovery that very low levels of glycerol esters that is up to about 0.2 percent by weight, provide optimum performance in terms of actual evaluation of fuel economy data. No benefit is obtainable in using relatively higher amounts and in some cases substantial debits in terms of formulation stability or adverse performance may occur.

Another reference disclosing the use of polyol carboxylic acid esters in lubricating oil compositions is U.S. Pat. No. 3,933,659 issued Jan. 20, 1976 to Lyle et al which shows a multi-component functional fluid, one component of which can be a polyol ester friction modifier or a fatty acid amide friction modifier. The primary use disclosed in that reference is for automatic transmission fluids. U.S. Pat. No. 3,273,891 issued Sept. 20, 1966 to Furey et al discloses anit-wear additives comprising a mixture of dimer acids and a partial ester of a polyhydric alcohol, the additive being noted as improving lubricity as well as functioning in the anti-wear category. U.S. Pat. No. 3,112,271 to Calhoun discloses glycerol monooleate as an extreme pressure additive as does U.S. Pat. No. 3,112,269 issued Nov. 23, 1963 to Calhoun et al and U.S. Pat. No. 3,041,284 issued Jan. 26, 1962 to Calhoun et al. U.S. Pat. No. 2,493,483 issued to Frances et al on Jan. 3, 1950 discloses marine engine lubricants which contain a partial ester of glycerol or other polyol fatty acid esters in amounts of from 0.05 to 1 percent.

Other references disclosing polyol esters of fatty acids are represented by U.S. Pat. No. 2,788,326 issued to Bondi et al issued Apr. 9, 1957 which discloses these compounds as being useful in extreme pressure lubricants and U.S. Pat. No. 2,527,889 issued Oct. 31, 1950 to Moore et al which shows the same polyol esters, such as glycerol monooleate, being useful as anti-corrosion agents in turbine oils in diesel fuels.

The present invention is based upon the discovery that there is a certain range of additive concentration in connection with the use of polyol esters in crankcase lubricating oil compositions which imparts a degree of fuel economy per unit weight of additive not heretofore recognized by the art, when glycerol esters are employed in a fully formulated lubricating oil and evaluated by fired engine tests. Of equal significance is the fact that other desirable effects and properties of lubricating oils, e.g., compatibility, detergency and dispersancy, are not diminished.

In accordance with the present invention, there are provided fuel economy promoting lubricating oil compositions which comprise an oil of lubricating viscosity and, as the fuel economy additive, from 0.05 to 0.2 weight percent of a glycerol partial ester of a $C_{16}$–$C_{18}$ fatty acid, thereby providing a fuel economy improvement of about 1 to 3 percent when compared with the same lubricating oil composition without the fuel economy additive.

The lubricating oil compositions of the present invention comprise both straight grade and multigrade lubricating oil formulations for both gasoline and diesel (compression ignition) engines. Thus, in the practice of the present invention the lubricating oil compositions will contain those additive systems formulated to meet the viscosity requirements or other specifications as required for qualification as a gasoline engine or diesel lubricating oil. A straight grade lubricating oil formulation will normally contain conventional amounts of an ashless dispersant, a normal or basic metal detergent, an anti-wear additive and anti-oxidant and a multi-grade oil will contain, in addition to the foregoing, a viscosity index improver or viscosity modifier. In addition to these principal additives, very small proportions of other special purpose additives, such as pour depessants, rust inhibitors, anti-foamants and the like are conventionally blended into lubricating oil compositions.

The fuel economy additive of the present invention is preferably a glycerol mono- or di-ester of a saturated or unsaturated $C_{16}$–$C_{18}$ fatty acid such as oleic or linoleic acid. Optimum efficiency has been found to be at about the 0.2 weight percent level and use in the excess of this amount may even be detrimental to the overall performance of the lubricating oil composition.

Crankcase oil formulations to which the present invention relates are those which contain a major amount of lubricating oil and effective amounts of conventional additives in addition to the aforesaid fuel economy additive. Percentages of additives as described herein are by weight based on the total weight of lubricating oil formulation unless otherwise reported.

These conventional additives comprise an ashless dispersant which is typically a nitrogen-containing dispersant additive which are oil-soluble salts, amides, imides and esters made from high molecular weight mono- and di-carboxylic acids and various amines having an amino or heterocyclic nitrogen with at least one amido or hydroxy group cabable of salt, amide or ester formation. Preferred are the reaction products of polyolefin ($C_2$–$C_5$ olefin), such as polyisobutenyl, succinic anhydride with an alkylene polyamine such as tetraethylenepentamine. The polyisobutenyl portion has between 50 and 250 carbon atoms. The alkylene polyamines are those represented by the formula:

$$NH_2(CH_2)_n(NH(CH_2)_n)_m—NH_2$$

where n is 2 to 3 and m is a number from 0 to 10. Mixtures of alkylene polyamines which approximate tetraethylenepentamine are commercially used materials. Dispersants are used generally in amounts of from about 0.1 to 10 wt. %, preferably in the range of about 0.5 to 5 wt. % based on the weight of the lubricating oil composition.

Detergents useful in the formulations include the normal, basic or overbased metal, that is, calcium, magnesium and so forth, salts of petroleum naphthenic acids, petroleum sulfonic acids, alkyl benzene sulfonic acids, alkyl phenols, alkylene-bis-phenol, oil-soluble fatty acids and the like. The preferred materials are the normal or overbased calcium or magnesium phenates, sulfurized phenates and/or sulfonates, and these metal-containing detergent additives are typically used in amounts of from 1 to 3 wt. % based on the total weight of lubricating oil compositions.

Examples of suitable oxidation inhibitors are hindered phenols, such as 2,6-ditertiary butyl paracresol, amines, sulfurized phenol and alkyl phenothiazines; usually a lubricating oil will contain about 0.01 to 3 wt. % of oxidation inhibitor depending on its effectiveness.

Suitable pour point depressants, which are usually present in amounts of about 0.01 to 1 wt. %, include wax alkylated aromatic hydrocarbons, olefin polymers and copolymers, acrylate and methacrylate polymers and copolymers.

Anti-wear additives generally are the oil-soluble zinc dihydrocarbyldithiophosphates having at least a total of 5 carbon atoms, the alkyl group being preferably $C_2$–$C_8$. These are typically present in amounts of from 0.01 to 5 wt. %, preferably 0.5 t 1.5 wt. % in the lubricating oil.

Suitable conventional viscosity index improvers, or viscosity modifiers, are the olefin polymers such as polybutene, ethylene-propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrollidone or dimethylaminoalkyl methacrylate, post-grafted polymers of ethylene-propylene with an active monomer such as maleic anhydride which may be further reacted with an alcohol or an alkylene polyamine, styrene-maleic anhydride polymers post-reacted with alcohols and amines and the like. These additives are used in amounts of about 1.5% to 15% by wt., depending on the exact viscosity specifications desired.

Suitable hydrocarbon base stocks are those mineral oils of lubricating viscosity as measured by ASTM D-455 of from about 2 to 40, preferably 5 to 20 centistokes at 99° C.

These conventional additives are used in amounts normally necessary to provide their attendant functions in a formulated crankcase lubricating oil composition. Very small proportions of additional special purpose additives, such as anti-foam agents or rust inhibitors may also be present in a fully formulated lubricating oil composition.

The invention is further illustrated by the following Examples which are not to be considered as limitative of its scope.

EXAMPLE 1

The reference oil used in this example was a formulated straight grade 20W30 crankcase mineral lubricating oil (corresponding to ASTM "HR" oil) to which was added 0.2 weight percent of a glycerol monooleate (GMO) fuel economy additive or 0.2 weight percent of a fuel economy additive being a mixture (GMO/GDO) of glycerol monooleate and glycerol dioleate in a weight ratio of 3 parts of GMO to 2 parts of GDO in said mixture. The reference oil contained 2.10 wt. % dispersant, 1.10 wt. % antioxidant, 1.00 wt. % basic metal detergent, 1.95 wt. % anti-wear additive, 0.21 wt. % pour depressant and 0.001 wt. % anti-foam agent. This type of reference oil, which is generally accepted by the industry for establishing fuel economy data, provides a reproducible baseline against which fuel economy credits may be measured and is considered to provide test results which accurately reflect the effect of a given fuel economy additive.

Fuel economy was evaluated using the Laboratory Engine Fuel Economy Test (LEFET) summarized below:

The fuel economy test used is a fired engine procedure. The engine is a 5.0 L, V-8 Chevrolet engine coupled to a water cooled electric dynamometer. The engine is run with a dry sump by the use of external oil pumps. One pump supplies oil to the oil gallery from an external sump and a second pump scavenges the sump and returns the oil to the external sump. The conditions that the engine runs at are as follows:

| Condition | Speed (rpm) | Load (in lb) | Temperature (°C.) Coolant | Oil |
|---|---|---|---|---|
| 1 (idle)[a] | 800 | 400 | 80 | 98 |
| 2 (30 mph)[b] | 1200 | 450 | 80 | 98 |
| 3 (30 mph)[a] | 1200 | 900 | 80 | 98 |
| 4 (55 mph)[b] | 2200 | 900 | 80 | 98 |

[a]engine load higher than road load.
[b]engine load equivalent to road load.

The results are expressed as a percentage credit with respect to the referenced oil. Results at the 0.2 wt. % treat level for both GMO and the GMO/GDO mixture are set forth in Table I.

TABLE I

LEFET RESULTS

| Engine Condition | Fuel Economy Credit, % GMO | GMO/GDO |
|---|---|---|
| 1 | 4.0 | 2.6 |
| 2 | 2.5 | 3.0 |
| 3 | 1.5 | 1.8 |
| 4 | 0.9 | 0.6 |

TABLE I-continued

| LEFET RESULTS | | |
|---|---|---|
| | Fuel Economy Credit, % | |
| Engine Condition | GMO | GMO/GDO |
| Weighted Average | 1.9 | 1.8 |

EXAMPLE 2

(a) Comparative evaluations utilizing increased amounts of the GMO/GDO mixture, that is, at the 0.3 weight percent and 0.5 weight percent levels showed no increase in fuel economy credit for treatment at these levels and in some cases, an adverse effect on fuel economy credits or other lubricating oil performance criteria, such as increased piston deposit formation tendencies or poor results in bearing corrosion tests.

(b) Coefficient of friction (CF) testing using a Roxana Four-ball wear tester in accordance with the procedure described in ASTM D226-67 at 110° C., 2.5 RPM at both 15 kg and 3 kg was carried out with a formulated mineral oil (Base oil) containing conventional amounts of dispersant (2.12%) basic metal sulfonate (1.02%), anti-oxidant (0.72%), anti-wear additive (1.96%) and viscosity index improver (only present at 8.7 wt. % in test oils 5 and 6 to evaluate compatibility) to which was added varying amounts of the GDO/GMO mixture. The results in Table II below show essentially no additional friction reducing benefit at levels in excess of 0.2 wt. % and at 0.9 wt. % in the test hazing evidencing potential instability or incompatibility was observed.

TABLE II

| CF RESULTS | | | |
|---|---|---|---|
| Test Oil | CF (15 kg) | CF (3 kg) | Compatibility |
| 1. Base Oil | 0.23 | 0.19 | Clear |
| 2. Base Oil + 0.1% GDO/GMO | 0.18 | 0.14 | Clear |
| 3. Base Oil + 0.2% GDO/GMO | 0.11 | 0.11 | Clear |
| 4. Base Oil + 0.3% GDO/GMO | 0.11 | 0.11 | Clear |
| 5.* Base Oil + 0.4% GDO/GMO | 0.11 | 0.11 | Clear |
| 6.* Base Oil + 0.9% GDO/GMO | 0.10 | 0.10 | Hazy |

*8.7 wt. % of a V.I. improver was present only in formulations 5 and 6 since compatibility was important at these concentrations.

EXAMPLE 3

(a) The laboratory fuel economy test of Example 1 was repeated utilizing a 10W40 multigrade mineral oil containing 0.09 wt. % of the GMO/GDO mixture as the fuel economy additive. The oil contained about 14% by wt. of a multifunctional dispersant viscosity index improver, 0.5% dispersant, 1.85% of basic metal detergent, 0.75 wt. % of anti-wear additive and 0.75% antioxidant.

Table III shows the fuel economy credits over the oil used as the reference in Example 1.

TABLE III

| MULTI-GRADE OIL-LEFET RESULTS | |
|---|---|
| Engine Condition | Fuel Economy Credit, % |
| 1 | 5.9 |
| 2 | 0.5 |
| 3 | 0.9 |
| 4 | 1.1 |
| Weighted Average | 1.8 |

(b) Utilizing the same oil as Example 3(a) the laboratory fuel economy results were confirmed in the Proposed ASTM 5 Car Interim Fuel Economy Procedure which utilized the EPA car certification cycle in 5 automobiles having engine sizes of 2.3 liter, 2.8 liter, 3.7 liter, 3.8 liter and 5.0 liter. Five Car average fuel economy credit of 1.64% was obtained in one series of fuel economy tests.

What is claimed is:

1. A lubricating oil composition formulated for use as a crankcase lubricating oil composition for gasoline or diesel engines consisting essentially of a major amount of a mineral oil of a lubricating viscosity which has incorporated therein (i) about 0.20 weight percent of a glycerol partial ester said partial ester being a mixture of glycerol monooleate and glycerol dioleate, said mixture having weight ratio of 3 parts of glycerol monooleate to 2 parts of glycerol dioleate said ester providing a fuel economy improvement of about 1 to 3 percent when said lubricating oil composition is employed in the crankcase of said engines, (ii) an ashless dispersant, (iii) a metal detergent additive (iv) a zinc dihydrocarbyl dithiophosphate anti-wear additive and (v) an antioxidant, said dispersant, detergent, anti-wear additive and antioxidant being present in conventional amounts to provide their normal attendant functions.

2. The composition of claim 1 wherein said lubricating oil composition contains a viscosity index improver.

3. The composition of claim 1 wherein said composition is a gasoline engine lubricating oil composition.

4. The composition of claim 1 wherein said composition is a diesel engine lubricating oil composition.

* * * * *